United States Patent [19]

Wood

[11] Patent Number: 4,877,337

[45] Date of Patent: Oct. 31, 1989

[54] BAG WITH TOP COVER INCLUDING HANDLE

[75] Inventor: Jerry W. Wood, Kent, Wash.

[73] Assignee: Cello Bag Company, Inc., Seattle, Wash.

[21] Appl. No.: 310,304

[22] Filed: Feb. 13, 1989

[51] Int. Cl.[4] ..... B65D 33/06

[52] U.S. Cl. ..... 383/21; 383/120

[58] Field of Search ..... 383/21, 120, 10, 25, 383/28, 5

[56] References Cited

U.S. PATENT DOCUMENTS

| | | | |
|---|---|---|---|
| 1,733,219 | 10/1929 | Duvall | 383/21 |
| 3,370,630 | 2/1968 | Haugh et al. | 150/12 |
| 4,119,268 | 10/1978 | Segura | 383/21 |
| 4,252,269 | 2/1981 | Peppiatt | 383/21 |
| 4,539,705 | 9/1985 | Baines | 383/8 |
| 4,550,439 | 10/1985 | Peppiatt et al. | 383/21 |
| 4,573,203 | 2/1986 | Peppiatt | 383/8 |
| 4,696,050 | 9/1987 | Sengewald | 383/21 |
| 4,721,396 | 1/1988 | Sengewald | 383/120 |
| 4,730,943 | 3/1988 | Johnson | 383/120 |
| 4,738,546 | 4/1988 | Sengewald | 383/120 |

FOREIGN PATENT DOCUMENTS

| | | |
|---|---|---|
| 2155091 | 5/1972 | Fed. Rep. of Germany . |
| 2157072 | 6/1973 | Fed. Rep. of Germany . |
| 2053590 | 4/1971 | France . |

OTHER PUBLICATIONS

"Nonwovens and Disposables" Proceedings of 1st Canadian Symposium on Nonwoven and Disposables, Mar. 15-16, 1977 Queen Elizabeth Hotel, Montreal, Canada, available from Technomic Publications.

*Primary Examiner*—Jimmy G. Foster
*Assistant Examiner*—Kathryn M. Stemann
*Attorney, Agent, or Firm*—Delbert J. Barnard

[57] ABSTRACT

A top cover (22) of flexible thermoplastic material is provided at the upper end of a bottom-loaded plastic bag of a type having a closed top (10) and a "carton" look when filled. The top cover is connected by heat seals (44, 46) to upper peripheral portions of the bag. The top cover is heat sealed to itself at (56), dividing the top cover into a base (22) and a handle (24). The handle (24) includes a hand-receiving opening (76).

3 Claims, 2 Drawing Sheets

BAG WITH TOP COVER INCLUDING HANDLE

DESCRIPTION

1. Technical Field

This invention relates to bottom-loaded plastic bags which have a closed top and a "carton" look when filled. More particularly, it relates to the provision of this type of bag with a security cover at the top which is formed to include a carrying handle.

2. Background Art

Cubic bag packages which simulate a carton have become quite popular for packaging disposable infant diapers and adult briefs. These bags make it possible to create the "carton" look with a similar degree of packaging line automation, but with a much reduced material cost. The bag offers nearly one hundred percent surface availability for graphics, a perfectly contoured fit, and additional features such as add-on carrying handles. Also, the filled bags are readily stackable. A good background description of these bags appears in the article entitled, "Poly Bag Packaging For Disposable And NonWoven Products," by A.G. Thatcher, published Mar. 15, 1977, in Montreal, Canada. Reprints of this article are available from Technomic Publishing Co., Inc. of Lancaster, Pa.

A popular form of "cubic" bag, equipped with a "loop" type carrying handle, is disclosed by German Patent Publication No. 2,155,091, published May 10, 1972. This same bag and handle are disclosed in U.S. Pat. No. 3,370,630, granted Feb. 27, 1968, except that the bag is not shown in a full packed condition and the top of the bag is not accurately drawn. French Patent Publication No. 2,053,590, published on Apr. 16, 1971, also relates to a cubic bag and discloses three styles of carrying handles, each of which has opposite side portions which are heat sealed to the bag where the gusset meets the front and rear walls of the bag.

It is known to heat seal a handle web to a bag web and then cut the handle web to form the desired handle shape. German Patent Publication No. 2,157,072, published June 7, 1973, discloses the use of this method in the manufacture of a flat bag. U.S. Pat. No. 4,573,203, granted Feb. 25, 1986, to Harry R. Peppiatt, discloses the use of this method for providing a loop handle at the gusset end of a cubic bag.

U.S. Pat. No. 4,539,705, granted Sept. 3, 1985, to Patrick A. Baines, discloses a cubic bag having a strap-like handle which extends lengthwise of the gusset. The ends of the handle are connected to the endwalls of the filled bag. This patent sets forth a very comprehensive description of the various types of cubic bags which have been used for packaging disposable diapers and similar products.

The principal object of the present invention is to provide a bottom-loaded cubic bag, for use to package disposable diapers and similar products, having a cover member at the top of the bag which provides a security cover and a structural intermediary between the bag body and a handle.

DISCLOSURE OF THE INVENTION

Plastic bags of the present invention are basically characterized by front and rear panels, a top gusset between the panels at one end of the bag, and a fill opening at the opposite end of the bag. The panels and the gusset are connected together such that when the bag is filled, it will assume a substantially hexahedral shape. The bag of the invention also includes a top cover of flexible thermoplastic material having first and second end portions and a central portion between the end portions. The central portion is longer than the gusset is wide when the bag is filled and the gusset is flat. The first end portion of the top cover is connected to a first panel of the bag outwardly adjacent where the first panel meets the gusset. The second end portion is connected to the second panel of the bag outwardly adjacent where the second panel meets the gusset. The central portion of the cover is connected to itself along a line which extends longitudinally of the gusset. This connection line divides the cover into a lower base part which overlies the gusset and an upper handle part which is exposed above the base part. The handle part includes a hand-receiving opening extending laterally through the handle part. The hand-receiving opening is shaped to receive a person's hand.

In preferred form, the cover is connected to itself by a heat seal. Also, in preferred form, the base part of the top cover has a length substantially equal to the filled width of the bag, and a depth substantially equal to the filled depth of the bag.

Other objects, features and advantages of the invention are hereinafter set forth in the description of the best mode.

BRIEF DESCRIPTION OF THE DRAWINGS

In the drawings, like reference numerals are used to designate like parts throughout the several views, and.

BEST MODE FOR CARRYING OUT THE INVENTION

Figure 1:
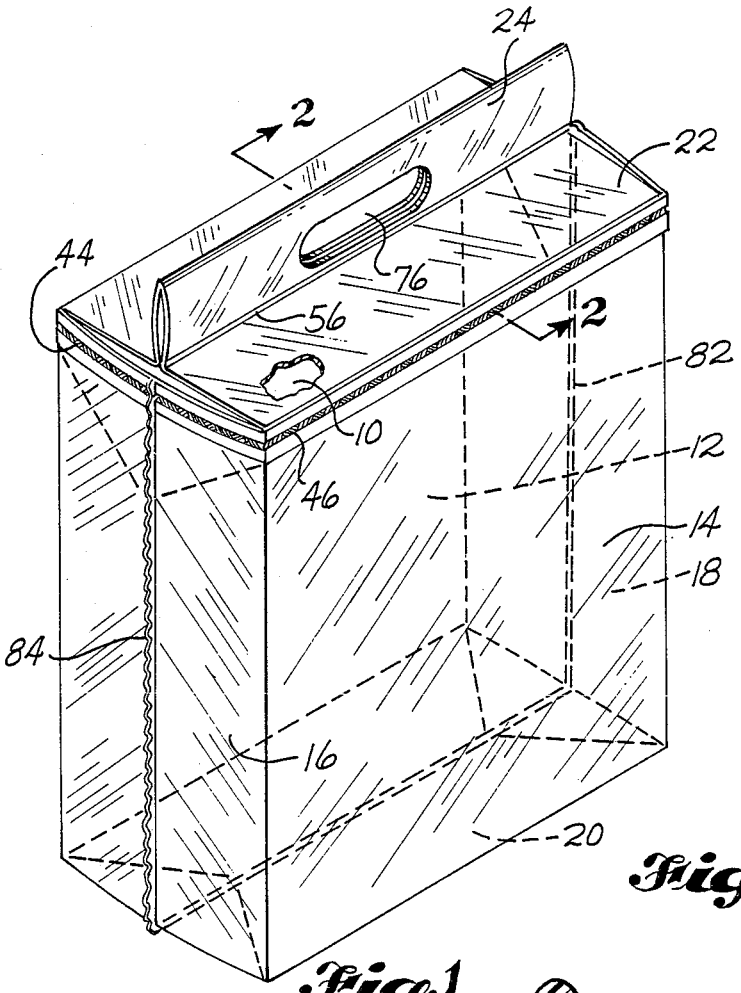
FIG. 1 is a pictorial view of a filled bag constructed according to the present invention, such view taken from above and looking towards the top, one end, and one side.

The bag of the invention, when filled, comprises a top 10, sides 12, 14, ends 16, 18, a bottom 20 and a top cover 22 formed to include a grip handle 24. As will hereinafter be explained, the bag is manufactured to, in an unfilled condition, have a closed top and an open bottom. The contents are inserted through the bottom and then the bottom is heat sealed closed.

Figure 4:
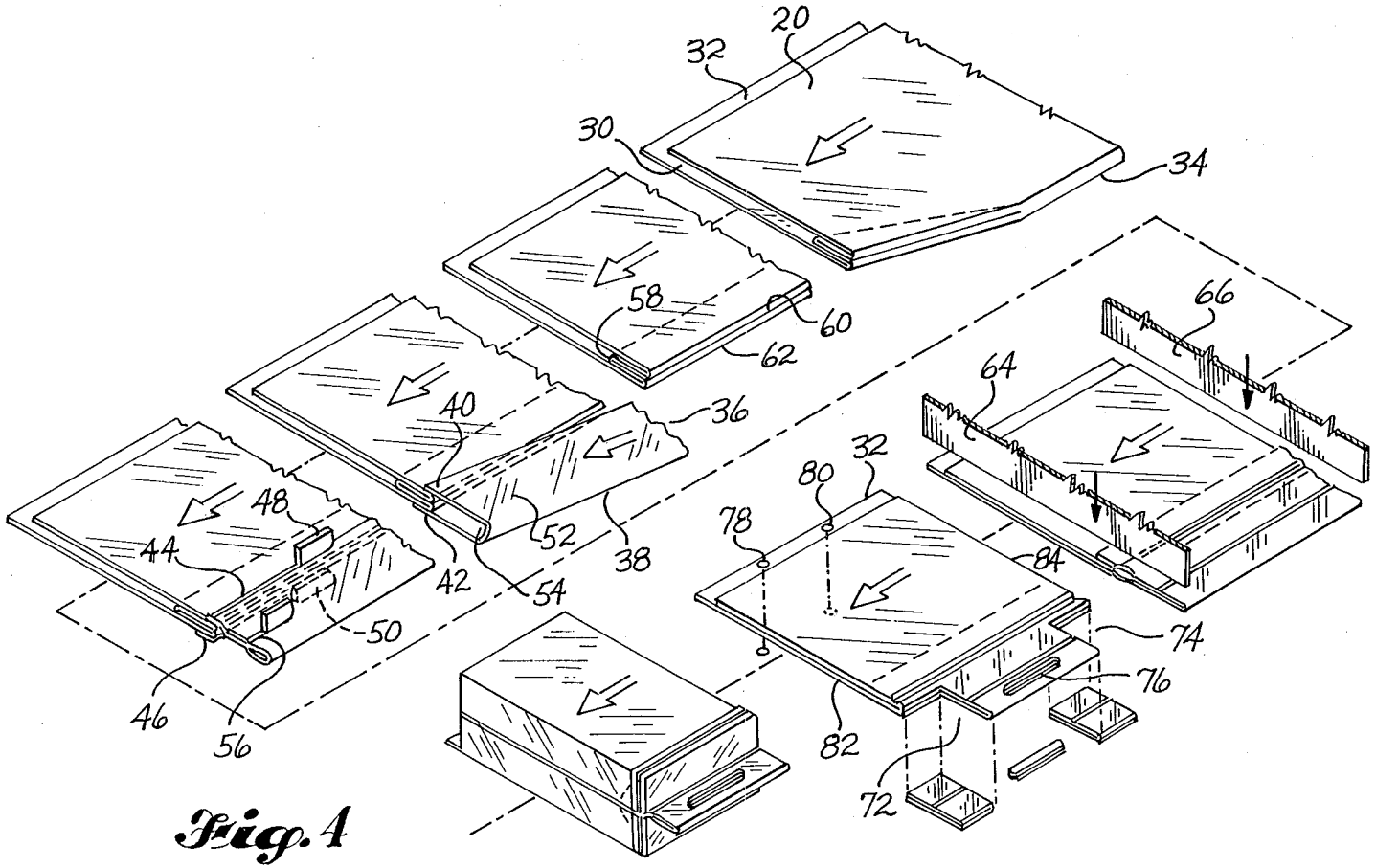
FIG. 4 is a diagrammatic view of the process used for manufacturing the bag of the invention.

Referring to FIG. 4, the bag is manufactured in the following manner: A continuous bag web 26 is fed off of a storage roll (not shown) and is then folded laterally on itself to define bag panels 28, 30 connected along a fold boundary 32. Bag panel 30 is slightly wider than bag panel 28, so as to define a lip 32. The fold boundary 32 is then tucked inwardly, to give the sheet material a substantially M-shaped cross section at the closed boundary. This region is commonly termed a "gusset", "fold" or "double fold". Next, a top cover web 36 is folded laterally on itself, so as to give it a substantially U-shaped cross section. The folded cover web 36 has a closed boundary 38 and an open boundary defined by edge portions 40, 42. These edge portions 40, 42 are guided into a position on opposite sides of the folded boundary 34 of bag web 26. The edge portions 40, 42 are then heat sealed to the bag web 26 along lines which extend longitudinally of the two webs 26, 36. In FIG. 4, heat sealers 48, 50 are shown positioned to produce the heat seals 44, 46.

According to the invention, the width of the folded web 36 measured from the heat seals 44, 46 to the folded outer boundary 38 is substantially wider than the folded width of the gusset panels. In the manufacturing process, the two panels 52, 54 of the cover web 36 are heat sealed together at 56. Heat seal 56 is linear and extends parallel to the heat seals 44, 46, and also parallel to the longitudinal boundaries of the webs 26 and 38. The distance laterally between heat seals 44, 46 and heat seal 56 is substantially equal to the folded width of the gusset at the closed boundary of the bag web 26. However, in preferred form, the distance between seals 44, 46, measured from seal 44 to seal 56 and from seal 56 to seal 46 is less than the distance measured from seal 44 to fold 58 to seal 46. This results in a slight narrowing of the filled width of the package.

Figure 3:
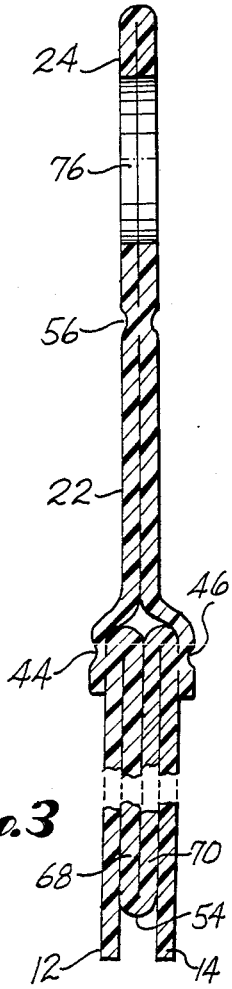
FIG. 3 is a view like FIG. 2, but with the bag in a flat, unfilled condition.
Figure 2:
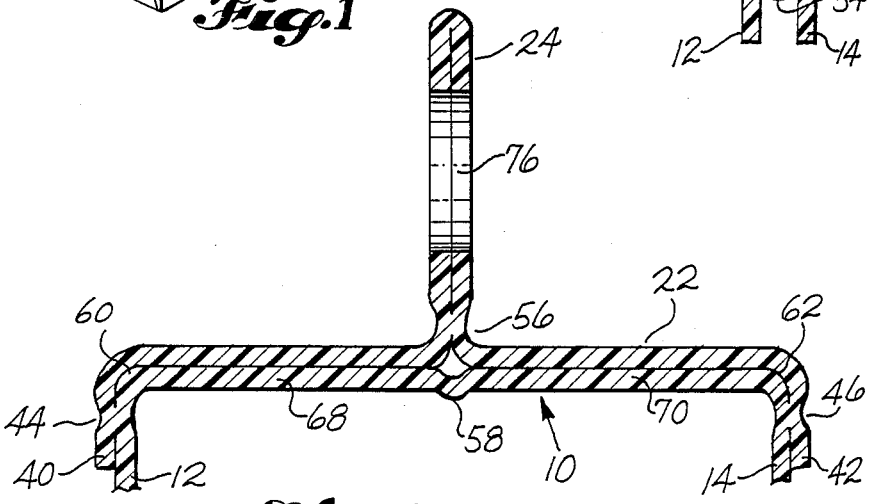
FIG. 2 is a fragmentary sectional view taken substantially along line 2—2 of FIG. 1.

Referring to FIGS. 2 and 3, the gusset which forms the top 10 is shown to have a natural crease 58 caused by the infolding of the closed boundary of the bag web 26. When the bag is filled, the outer folds 60, 62 become boundaries between the sides 12, 14 and the top 10. As shown by FIG. 2, the surface dimension between the heat seals 44, 46, measured along the top 10, is substantially equal to the surface dimension from seal 44 to seal 46 measured along the base portion of the cover member 22. The base portion of the cover member 22 is the portion situated below the heat seal 56. The handle 24 is formed from the portion of cover web 22 which extends upwardly from the heat seal 56. The cover web 22 is flexible as is the heat seal region 56. Accordingly, although the handle 24 is shown standing up in FIGS. 1 and 2, in reality, if not supported, it would fall to one side or the other and lay flat down on top of the base portion of the cover member 22, with the heat seal 57 functioning like a hinge.

Returning to FIG. 4, after the cover web 32 is heat sealed onto the bag web 26 along seal lines 44, 46, and after the heat seal 56 is formed, the joined-together webs 26, 36 are cut so as to delineate individual bags. FIG. 3 shows cutters 64, 66. These are heated blades which both cut the plastic material and heat seal the cut edges together. The heat sealing connects the edges of the panels 30, 32 together in the region below the gusset. In the gusset region, it connects together the side edges of the panels 28, 30 and the end edges of the gusset panels 68, 70. It also connects together the end edges of the cover web panels 52, 54.

According to the invention, the attached cover web 36 is cut at 72, 74. The width of each cutout 72, 74 is approximately equal to one half of the width of an end 16, 18 of the filled bag. As a result, the portion of the cover web 36 which remains between the cutout 72, 74 is of a length substantially equal to the width of the sides 12, 14 of the filled bag. This is illustrated in FIG. 1. A hand-receiving opening 76 of appropriate size and shape is formed in the handle 24. Also, wicket pin openings 78, 80 are punched or otherwise formed in the lip 32.

The bag itself, minus the cover member 22 and handle 24, is a well-known bag known as a "bread bag." The process of making this bag is disclosed in U.S. Pat. No. 3,370,630, granted Feb. 27, 1968, to Gordon A. Haugh and Charles E. H. Walters. This type of bag, in a filled condition, is well illustrated in FIG. 6 of German Patent Publication No. 2,155,061, published Nov. 5, 1971.

FIG. 4 shows cutouts 72, 74 being made after the bags are delineated. In actual practice, a cutout 74 for a leading bag, and a cutout 72 for a trailing bag, can be made at one time by a single cutting tool, and then the leading bag can be cut free of the connected webs 26, 36 by a single heated knife. In the drawings, the side seals are designated 82, 84.

The handle 24 may merely comprise the upper portions of panels 52, 54, or may comprise such upper portions in combination with a strengthening member that is placed between them before the heat seal 56 is made and the hand-receiving openings 76 are cut. The heat seal 56 may be used to secure such reinforcing strip in place. Also, when the hand-receiving opening 76 is cut, a heated cutter may be used which seals the edge portions of the opening. Also, the handle 24, either with or without a reinforcing strip, may be heat sealed together in the region above heat seal 56. The reinforcing strip may be stiff enough so that the handle functions as a beam.

The edge portions 40, 42 of the cover web 36, extending along the sides 12, 14 of the filled bag, distribute the carrying loads across a substantial width of the sides 12, 14. The base portion of the cover member 22 also covers the gusset 10, preventing unauthorized entry into the top of the bag.

For economical reasons, it is prefererd that both the bag web 26 and the cover web 36 be made from polyethylene film. However, other forms of thermoplastic material can be used. It is preferred that the heat seals 44, 46, 56 be formed by the use of hot air sealers. These hot air sealers are well known and readily available, as are the techniques for using them without making unwanted connections of the webs.

The basic bag that has been described has become popular as a package for disposable diapers. This is because the bag takes on a "carton" appearance when filled with the diapers. The unit cost of the bags is less than the unit cost of cardboard boxes. Also, it is generally more economical to load the diapers into the bags and then close the bag than it is to load the diapers into cardboard boxes and then close the cardboard boxes. One problem with plastic bags for diapers is that the bags are sometimes opened in the store and have diapers removed from them. The base portion of the cover member 22 prevents the top from being opened. It is believed that this is a deterrent to an unauthorized entry for the reason that a person is less likely to tear open the bag at some other location.

The bag which has been illustrated and described exemplifies the invention. However, the invention is not to be limited by the disclosed embodiment, but rather is to be determined by the appended claims, interpreted in accordance with established rules of patent claim interpretation, including use of the doctrine of equivalents.

What is claimed is:

1. A top gusset, bottom-loaded bag comprising a unitary piece of flexible thermoplastic material including first and second rectangular panels and a rectangular gusset integral in one piece with said panels and extending between said panels at the top end of the bag, and said edge seals connecting said panels and said gusset together in a manner resulting in the bag approximating the shape of a hexahedron when filled and when closed at its bottom, and the improvement comprising:

a top cover of flexible thermoplastic material having first and second end portions and a central portion between said end portions that is longer than the gusset is wide when the bag is filled and the gusset is substantially flat;

said first end portion being connected to the first panel outwardly adjacent where said first panel meets the gusset;

said second end portion being connected to the second panel outwardly adjacent where the second panel meets the gusset;

said central portion of the cover being connected to itself along a line extending longitudinally of the gusset, to divide the cover into a lower base part which overlies said gusset and an upper handle part which is exposed above said base part; and said handle part including a hand-receiving opening extending laterally through the handle part which is shaped to receive a person's hand.

2. The improvement of claim 1, wherein the cover is connected to itself by a heat seal.

3. The improvement of claim 1, wherein the base part of the top cover has a length substantially equal to the filled width of the bag and a depth substantially equal to the filled depth of the bag.

* * * * *

UNITED STATES PATENT AND TRADEMARK OFFICE

CERTIFICATE OF CORRECTION

PATENT NO. : 4,877,337

DATED : October 31, 1989

INVENTOR(S) : Jerry W. Wood

It is certified that error appears in the above-identified patent and that said Letters Patent is hereby corrected as shown below:

Claim 1, col. 4, line 62, "said edge" should be -- side edge --.

Signed and Sealed this

Sixteenth Day of October, 1990

*Attest:*

HARRY F. MANBECK, JR.

*Attesting Officer*

*Commissioner of Patents and Trademarks*